United States Patent [19]

Miller

[11] 3,940,120

[45] Feb. 24, 1976

[54] DUST FREE ASPHALT PRODUCTION METHOD AND APPARATUS

[75] Inventor: John S. Miller, Issaquah, Wash.

[73] Assignee: The Boeing Company, Seattle, Wash.

[22] Filed: Aug. 5, 1974

[21] Appl. No.: 494,787

[52] U.S. Cl. ..... 259/158

[51] Int. Cl.[2] ..... B28C 1/22; B28C 5/46

[58] Field of Search..... 259/78, 72, 159 A, 159 R

[56] References Cited

UNITED STATES PATENTS

| | | | |
|---|---|---|---|
| 1,020,633 | 3/1912 | Brennan | 259/159 A |
| 1,337,953 | 4/1920 | Popkess | 259/159 A X |
| 1,622,762 | 3/1927 | Bressler | 259/159 A X |
| 1,836,261 | 12/1931 | Madsen | 259/159 A X |
| 1,984,315 | 12/1934 | Morris | 259/159 R X |

*Primary Examiner*—Stanley N. Gilreath
*Assistant Examiner*—Donald B. Massenberg
*Attorney, Agent, or Firm*—Donald A. Streck

[57] ABSTRACT

Method and apparatus for reducing the particulate emission from apparatus producing asphalt-concrete to a level compatible with environmental pollution acceptable limits by forming the moist sticky mixture of bituminous composition and aggregate into a filter veil and directing substantially all of the dust laden heated gas stream passing through the mixing chamber through said filter veil.

6 Claims, 7 Drawing Figures

Fig. 1
PRIOR ART
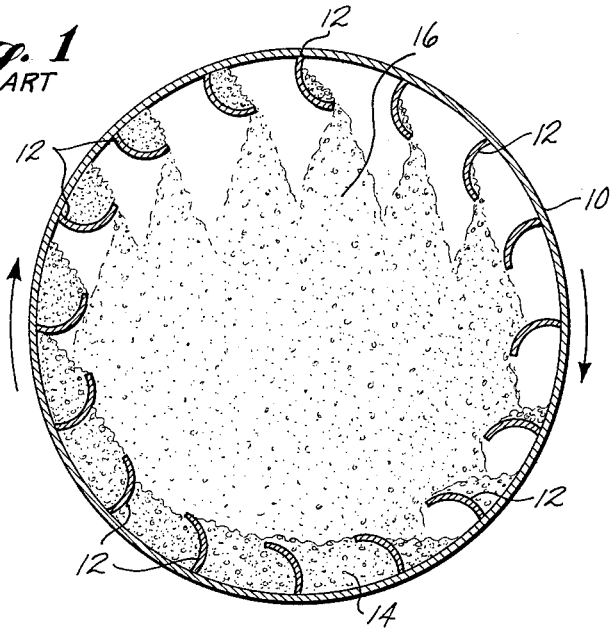
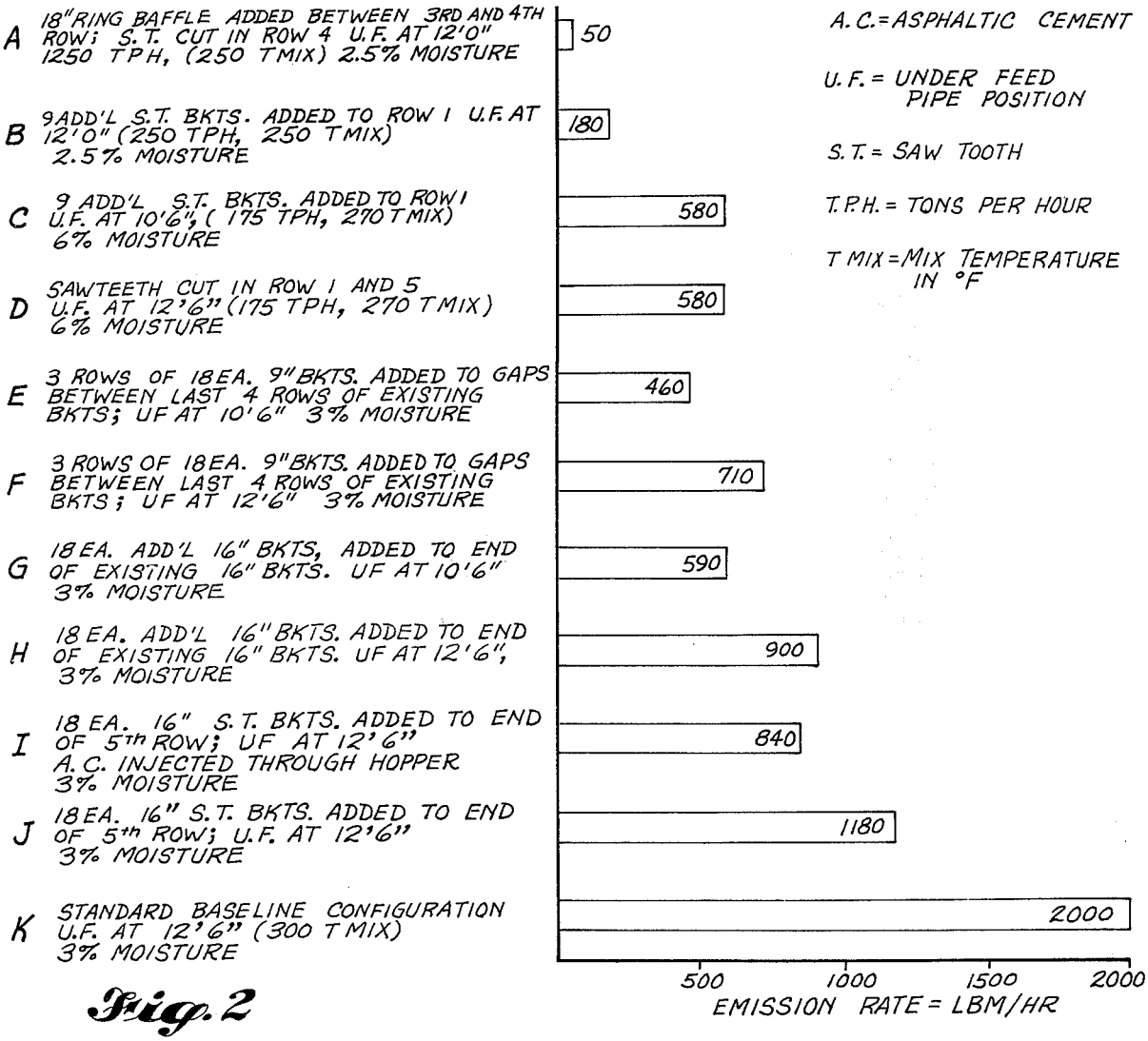
Fig. 2

Fig. 6
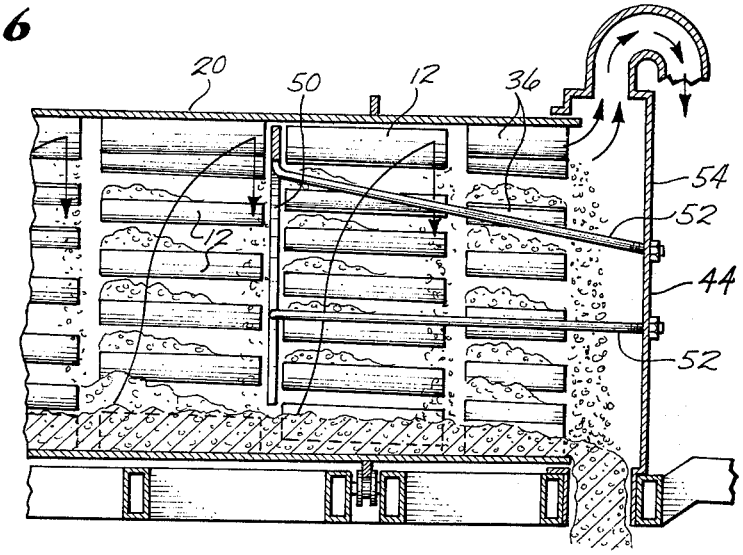
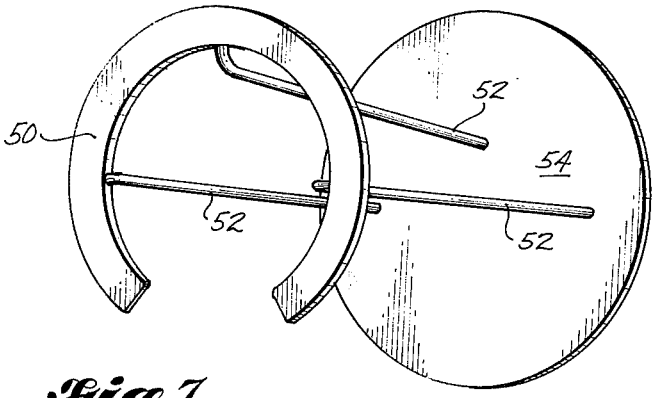
Fig. 7

DUST FREE ASPHALT PRODUCTION METHOD AND APPARATUS

BACKGROUND OF THE INVENTION

1. Field of the Invention

Relates to processes and apparatus for producing asphaltconcrete and more particularly to apparatus and methods for reducing particulate emission from a dryer-drum mixer in the production of asphalt paving compositions.

2. Description of the Prior Art

Bituminous pavements of the plant mix type have traditionally been produced for the most part by drying aggregate in a drum dryer, feeding the dried aggregate into a screening unit capable of separating the dried aggregate into fractions held in a series of storage bins, feeding the fractions in proportioned amounts from the bin units, and mixing the proportioned amounts with a predetermined amount of bituminous composition in a mixing unit of the pug mill type. The drum dryers used to dry the aggregate are generally heated by a forced air burner. Particulate emissions from dryers of this type have posed a problem due to increasingly stringent air pollution regulations. Dust collectors of the "baghouse" or "scrubber" types, costing tens of thousands of dollars per plant, are presently the means used to control particulate emissions from drum dryers used in drying aggregate.

Asphalt paving compositions have also been made in a continuous drum type mixing plant, by feeding aggregate into the mixer, contacting it in the mixer with a bituminous composition in the form of an emulsion, and heating the mixture, during mixture of the aggregate and bituminous composition, with a heated gas stream flowing counter-current to the flow of the aggregate-bituminous composition flow.

More recently, Shearer in his U.S. Pat. No. 3,832,201 disclosed a process and apparatus for making asphalt paving compositions wherein cold, wet aggregate is contacted with a liquefied asphalt composition just prior to or concurrently with introduction of the aggregate into a relatively high velocity, heated gas stream flowing parallel to the direction of the aggregateasphalt mixture through a mixing and drying zone. In the heated atmosphere, the mixture of aggregate and asphalt is mixed while being heated to coat the aggregate particles with asphalt and the coated particles are cascaded through the heated atmosphere to remove moisture therefrom without substantial aging or hardening of the asphalt.

While the basic Shearer process for asphalt production was considered to be pollution free in regard to particulate emission at that time, more stringent environmental protection standards imposed recently in many areas often require greater particulate emission control than is possible with the aggregate supplied locally using the basic Shearer process as originally disclosed.

Therefore, it is an object of the present invention to provide an improved dryer-mixture asphalt process and apparatus which will substantially reduce particulate emissions.

It is still another object of the present invention to provide an improved dryer-mixer asphalt process and apparatus with minimal particulate emissions providing improved thermal efficiency.

DESCRIPTION OF THE DRAWINGS

FIG. 1 cross section through a standard prior art mixer drum in operation showing the natural asphalt-aggregate veil created.

FIG. 2 graph of Motheral Emission Test summary of various mixer-drum and operation parameter configurations.

FIG. 6 partial cutaway side elevation of an asphalt mixer-drum employing an alternate embodiment of the present invention.

FIG. 7 detailed drawing of the apparatus of FIG. 6.

DESCRIPTION AND OPERATION OF THE PREFERRED EMBODIMENT

Figure 3:
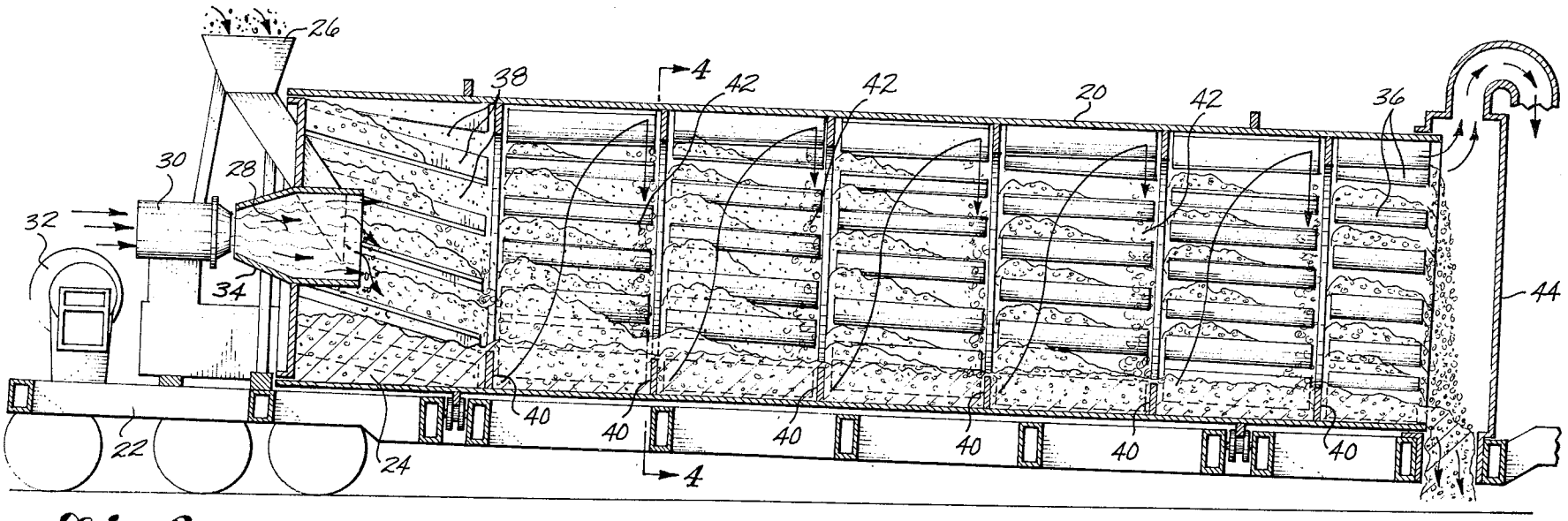
FIG. 3 cutaway side elevation of an asphalt mixer-drum employing the present invention in its preferred embodiment.

In analyzing the particulate retention properties of the basic Shearer process, it was discovered that the moist tacky asphaltaggregate mixture formed a veil across a portion of the cross section of the mixer-drum as shown in FIG. 1. Drum 10 is fitted with longitudinal flights 12 to mix the asphalt-aggregate mixture 14. As drum 10 revolves, asphalt-aggregate mixture 14 is lifted by flights 12 and is dumped by flights 12 as they change position creating veil 16. In the area not occupied by the veil 16, particulate laden air can pass by unhinered while particulate laden air striking and passing through the veil 16 is filtered. In order to improve this natural filtering capability sufficiently to meet environmental standards a number of considerations had to be provided for:

1. The veil must be as dense as possible.
2. The veil must cover as much of the cross sectional area of the mixer-drum as possible so that substantially all of the particulate laden air will pass through the veil.
3. The progress of the asphalt-aggregate mixture through the mixer-drum must not be substantially hindered.
4. Since the asphalt-aggregate mixture is dried in the mixer-drum by the air to be filtered, the flow rate of air (about 80,000 cubic feet per minute typical for large dryers) must not be adversely effected.

The invention hereinafter described was able to satisfy these criteria while providing the desired particulate emission elimination.

In attempting to find a solution to the problem, such obvious and well known techniques as staggering the flights and adding flights along the inner periphery of the mixer-drum and making the edge of the flights sawtoothed instead of straight were employed the attendant expected results - an improvement in veil density and coverage with a reduction in particulate emission. The results of these tests are shown in FIG. 2. While conducting these tests, various methods of mounting and configurations of the buckets (flights) within the mixer-drum were attempted. Included, therein, was the use of a narrow (18 inch) ring around the periphery of the mixer-drum adjacent to the ends of one of rows of buckets. The dramatic and unexpected results of the inclusion of this ring acting as a baffle is shown in the test results as configuration A.

In interpreting the test results as shown in FIG. 2, it is important to note that they were conducted under field-not laboratoryconditions. Generally, the parameters effect the particulate emission rate in the following manner:

1. The higher the moisture content of the aggregate as input, the lower the emissions.
2. The closer the asphalt feed to the front of the drum, the lower the emissions.
3. The greater the production rate in tons per hour (TPH), the thicker the veil and, therefore, the lower the emission per ton of throughput.

Referring to FIG. 2, not that by adding additional buckets and adjusting their configuration it was possible to reduce the particulate emission rate to approximately 10% of its original baseline configuration rate. However, not only is the addition of buckets more expensive and complex, but the resulting pollution level of particulate emissions is still well above established environmental standards. Note then, that by the inclusion of the narrow baffle ring which is the subject of the present invention, it was possible to achieve almost a 75% reduction from this level to a point representing only 2.5% of the baseline configuration - within acceptable limits in many areas.

Figure 4:
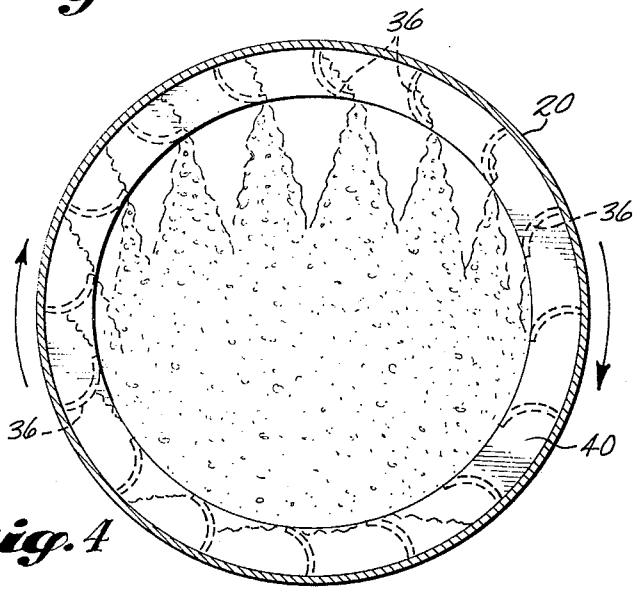
FIG. 4 cutaway end view of the mixer-drum of FIG. 3.

The baffle ring which is the subject of the present invention is best understood by referring to FIG. 3 and FIG. 4. Mixer-drum 20 is rotatably mounted on chassis 22. As mixer-drum 20 is rotated, asphalt and aggregate 24 are added through hopper 26. Hot air 28 is forced through the mixer-drum 20 by heater 30 and blower 32 entering through shroud 34. Flights or buckets 36 are attached to the inside periphery of the mixer-drum 20. As mixer-drum 20 revolves, flights 36 pickup and lift the asphalt and aggregate 24 to the top of the mixer-drum 20 where they are dropped, thus causing the asphalt and aggregate 24 to be mixed so that all the aggregate is coated completely with asphalt. Movement of hot air 28 across the newly entered and, as yet, unmixed asphalt and aggregate 24 near the hopper end of mixer-drum 20 causes the light aggregate dust or fines 38 to be carried along with the stream of hot air 28. By adding baffle rings 40 around the inside periphery of mixer-drum 20, the flow of hot air 28 containing fines 38 is deflected sufficiently to cause substantially all of the fines 38 to impinge on the asphalt in the asphalt and aggregate 24 comprising natural veils 42 where the lifted asphalt and aggregate 24 falls. Fines 38 are thereby filtered from hot air 28 and mixed into the asphalt and aggregate mixture 24.

The initial installation which lead to the discovery of the present invention and produced the results labeled configuration A of FIG. 2 comprised one baffle ring 40, 18 inches wide, located approximately two-thirds the length of the mixer-drum 20 from the input hopper 26 end. In the preferred embodiment as presently contemplated and shown in FIG. 3 and FIG. 4, five baffle rings 40, 12 inches wide are used. The 12 inch width just covers the innermost projection of the buckets 36. The quantity of five represents one baffle ring 40 between each row of buckets 36. In this manner, the flow of both the asphalt and aggregate 24 and the hot air 28 are substantially unrestricted while the path of travel of hot air 28 containing fines 38 is altered to cause substantially all the fines 38 to be directed through veils 42. Due to the inclined operation of such equipment as shown in FIG. 3, wherein the inlet end containing hopper 26 is higher than the outlet end 44, each time asphalt and aggregate 24 is lifted and dropped, they fall a little closer to the outlet end 44. Not only does this lifting and dropping cause the asphalt and aggregate 24 to move through mixer-drum 20, but additionally, baffle rings 40 do not substantially hinder the progress of asphalt and aggregate 24 since the lifting and dropping action simply causes asphalt and aggregate 24 reaching baffle ring 40 to be lifted and dropped on the other side of said baffle ring 40. This is to be clearly distinguished from such apparatus as that disclosed by Brock in his U.S. Pat No. 3,693,945 in FIG. 4. In said embodiment of his invention, Brock discloses a conical insert 76 to form a funnel shape (page 5, lines 30-65) causing the aggregate and air to pass through a greatly reduced opening where the asphalt is then introduced in the form of a spray. While the conical insert 76 would direct the air exiting therefrom through any asphalt veil which might exist in the mixing zone 79 as well as the asphalt spray created at the constricted funnel end opening of said conical insert 76, it would do so at the expense of hindering both the air flow and aggregate flow. Not only would this reduce the throughput of the apparatus, but, reduce the particulate filtering ability since the veil thickness is directly related to the volume of throughput in tons per hour as herein previously stated. Consequently, the ability to deflect the air flow through the filter veil without hindering air or aggregate flow as is possible with the present invention is a critical distinction.

The baffle rings 40 provide improved operation both as to thermal efficiency and particulate filtering during perids of operation at less than maximum throughput. The baffle rings 40 tend to cause the asphalt-aggregate mixture 24 to seek the baffle ring 40 thickness level adjacent to each baffle ring 40. As the asphaltaggregate mixture 24 is lifted and dropped, part of the asphalt-aggregate mixture 24 falls over the baffle ring 40 and part falls back behind. While this does not substantially hinder the flow of the asphalt-aggregate mixture 24 through the mixer-drum 20, it causes a bunching up at the baffle rings 40 which causes a thicker veil 42 in these areas adjacent the baffle rings 40 which would otherwise be less dense during periods of lower throughput. These thicker veils 42 promote better thermal efficiency and filtering as has been hereinbefore described.

Figure 5:
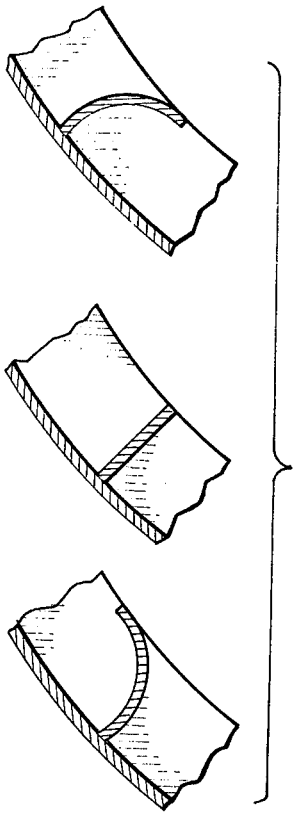
FIG. 5 cross section through various baffle ring configurations.

While the preferred embodiment as disclosed herein is in the form of a solid ring of rectangular cross section, it is to be understood that the method of practicing the present invention can be accomplished with various configurations of apparatus. FIG. 5 shows various cross sectional configurations possible. Additionally, the baffle rings 40 can be solid, segmented, or comprised of a series of plates attached close adjacent one another about the inner periphery of the mixer-drum 20 so as to give the same effect as a solid ring.

A further embodiment of the present invention is shown in FIG. 6 and FIG. 7. In this embodiment, a partial baffle ring 50 is held in place between two adjacent rows of buckets 36 by support means 52 attached to end plate 54 of the outlet end 44. In this embodiment, the partial baffle ring 50 remains fixed while the mixer-drum 20 revolves about it. While a full ring could be used, a partial ring as shown is preferred as adding less weight for the support means 52. This embodiment is primarily envisioned for retrofitting existing installations. The positioning of the partial baffle ring 50 would be dictated by the existing equipment configuration and the support means 52.

Having thus described my invention, I claim:

1. The method of substantially reducing the amount of fines emitted into the atmosphere in the operation of apparatus for preparing asphalt paving material by mixing bituminous liquid and aggregate containing fines comprising the steps of:

a. providing a substantially horizontal rotatable mixer-drum having an inlet at one end and an outlet at the opposite end, said mixer-drum having a plurality of buckets disposed along the length of said mixer-drum substantially equally spaced around the inside periphery of said mixer-drum;

b. inserting bituminous liquid and aggregate containing fines into said mixer-drum;

c. causing hot air to pass through said mixer-drum entering at said inlet and exiting at said outlet;

d. rotating said mixer-drum to lift and drop said bituminous liquid and aggregate containing fines in said mixer-drum as said mixer-drum is rotated and said hot air is passed through said mixer-drum so as to mix said bituminous liquid, said aggregate, and a portion of said fines and create a veil of bituminous liquid coated aggregate in a portion of said mixer-drum; and, e. causing the flow of said hot air containing fines passing along the inner periphery of said mixer-drum from said inlet to said outlet to be deflected through said veil of bituminous liquid coated aggregate, by deflection means disposed adjacent to the inner periphery of said mixer-drum the progress of said aggregate and said air in volume passing through said mixer-drum being substantially unhindered while substantially all of said fines are directed toward and caused to impinge upon the asphalt coated aggregate comprising said veil.

2. The improvement substantially reducing the amount of fines emitted into the atmosphere by apparatus preparing asphalt paving material, said apparatus comprising:

a rotatable substantially horizontal mixer-drum having an inlet at one end and an outlet at the opposite end;

means inserting bituminous liquid and aggregate containing fines into said mixer-drum;

means causing hot air to pass through said mixer-drum entering at said inlet and exiting at said outlet; and, a plurality of buckets disposed along the length of said mixer-drum in rows substantially equally spaced around the inside periphery of said mixer-drum, said plurality of buckets being so disposed as to lift and drop said bituminous liquid and aggregate containing fines in said mixer-drum as said mixer-drum is rotated and said hot air is passed through said mixer-drum so as to mix said bituminous liquid, said aggregate, and a portion of said fines and create a veil of bituminous liquid coated aggregate in a portion of said mixer-drum; said improvement comprising:

a. baffle means comprising a substantially vertical, flat, ring-shaped plate disposed adjacent the inner periphery of said mixer-drum deflecting said hot air passing through said mixer-drum from said inlet to said outlet through said mixer-drum into said veil of bituminous liquid coated aggregate, said baffle means being such that the progress of said aggregate and said air in volume passing through said mixer-drum is substantially unhindered while substantially all of said fines are directed toward and caused to impinge upon the asphalt coated aggregate comprising said veil.

3. The improvement substantially reducing the amount of fines emitted into the atmosphere by apparatus preparing asphalt paving material as claimed in claim 2 wherein:

said baffle means is carried by said mixer-drum and revolves with said mixer-drum as said mixer-drum is revolved.

4. The improvement substantially reducing the amount of fines emitted into the atmosphere by apparatus preparing asphalt paving material as claimed in claim 2 wherein:

said baffle means is carried by support means maintaining said baffle means non-movably adjacent said inner periphery of said mixer-drum while said mixer-drum is revolved.

5. The improvement substantially reducing the amount of fines emitted into the atmosphere by apparatus preparing asphalt paving material as claimed in claim 4 wherein:

said baffle means is a complete ring.

6. The improvement substantially reducing the amount of fines emitted into the atmosphere by apparatus preparing asphalt paving material as claimed in claim 4 wherein:

said baffle means is a partial ring with the portion adjacent the bottom of said mixer-drum being the open portion of said partial ring.

* * * * *